US009269511B2

(12) United States Patent
Lam

(10) Patent No.: US 9,269,511 B2
(45) Date of Patent: Feb. 23, 2016

(54) HAND CONTROLLED ELECTRONICS TOY ARTICLE

(76) Inventor: Peter Ar-Fu Lam, Torrance, CA (US)

( * ) Notice: Subject to any disclaimer, the term of this patent is extended or adjusted under 35 U.S.C. 154(b) by 1270 days.

(21) Appl. No.: 10/242,847

(22) Filed: Sep. 13, 2002

(65) Prior Publication Data

US 2003/0030441 A1 Feb. 13, 2003

Related U.S. Application Data

(63) Continuation-in-part of application No. 09/896,434, filed on Jun. 29, 2001, now Pat. No. 6,586,942, and a continuation-in-part of application No. 10/118,706, filed on Apr. 8, 2002, now Pat. No. 8,641,474.

(60) Provisional application No. 60/324,202, filed on Sep. 22, 2001.

(51) Int. Cl.

| | |
|---|---|
| ***A63H 33/00*** | (2006.01) |
| ***A63F 9/24*** | (2006.01) |
| ***H01H 13/70*** | (2006.01) |
| *H01H 9/02* | (2006.01) |

(52) U.S. Cl.

CPC ..... *H01H 13/70* (2013.01); *A63F 9/24* (2013.01); *A63H 33/00* (2013.01); *A63H 2200/00* (2013.01); *H01H 2009/0221* (2013.01); *H01H 2207/026* (2013.01); *H01H 2223/026* (2013.01); *H01H 2223/04* (2013.01); *H01H 2300/022* (2013.01)

(58) Field of Classification Search

CPC ..... A63F 13/20; A63F 13/21; A63F 13/24; A63F 2250/025; A63F 2250/491; A63F 2250/495; A63F 9/24; A63F 2009/2407; G05G 9/00; G05G 9/047; G05G 2009/04774; A63H 33/00; A63H 33/26; A63H 2200/00

USPC ..... 446/26, 175, 484; 324/426; 345/158, 345/156; 273/238, 148 B; 463/30

See application file for complete search history.

(56) References Cited

U.S. PATENT DOCUMENTS

| | | | | | |
|---|---|---|---|---|---|
| 3,949,517 | A * | 4/1976 | Reiner | A63H 11/18 | 439/37 |
| 4,320,387 | A * | 3/1982 | Powell | G04G 21/00 | 379/93.12 |
| 4,529,389 | A * | 7/1985 | Kennedy et al. | 446/26 | |
| 4,820,229 | A * | 4/1989 | Spraggins | 446/26 | |
| 5,488,362 | A * | 1/1996 | Ullman | A63F 13/06 | 273/148 B |
| 5,766,077 | A * | 6/1998 | Hongo | A63F 13/02 | 273/148 B |
| 5,971,855 | A * | 10/1999 | Ng | A63F 13/12 | 463/40 |
| 5,976,018 | A * | 11/1999 | Druckman | A63F 13/08 | 273/148 B |
| 5,995,034 | A * | 11/1999 | Liu | G05G 9/047 | 341/161 |
| 6,050,695 | A * | 4/2000 | Fromm | A44C 15/0015 | 362/104 |
| 6,128,004 | A * | 10/2000 | McDowall | G06F 3/014 | 345/156 |
| 6,247,934 | B1 * | 6/2001 | Cogliano | 434/159 | |
| 6,441,721 | B1 * | 8/2002 | Tajima | G07C 9/00111 | 340/286.01 |

(Continued)

*Primary Examiner* — Gene Kim
*Assistant Examiner* — Alyssa Hylinski

(57) ABSTRACT

Communication means allowing a hand controlled toy play set to communicate data with another play set article or a joystick through hand contact or hand shake motion. Said toy play set comprises memory means and identity means to represent the performance parameters and personality of a toy member.

27 Claims, 8 Drawing Sheets

(56) References Cited

U.S. PATENT DOCUMENTS 6,586,942 B2 * 7/2003 Lam ..... H01H 13/70 324/426
6,773,325 B1 * 8/2004 Mawle ..... A63F 13/02 446/175
6,809,721 B2 * 10/2004 Love ..... G06F 1/1616 345/157
6,811,491 B1 * 11/2004 Levenberg ..... A63F 13/02 273/148 B
6,906,700 B1 * 6/2005 Armstrong ..... G05G 9/04737 345/156
7,081,033 B1 * 7/2006 Mawle ..... A63F 13/02 446/175
7,082,316 B2 * 7/2006 Eiden ..... H04B 13/005 340/7.46
7,314,407 B1 * 1/2008 Pearson ..... A63F 13/12 463/29
8,641,474 B2 * 2/2014 Lam ..... H01H 13/70 446/397
2002/0067334 A1 * 6/2002 Hinckley ..... A63F 13/06 345/156
2002/0109596 A1 * 8/2002 Phillips ..... G08B 1/08 340/573.1

* cited by examiner

HAND CONTROLLED ELECTRONICS TOY ARTICLE

This is a formal patent application of provisional patent application 60/324,202 filed Sep. 22, 2001. It is also a continuation in part of the U.S. patent application Ser. No. 09/896,434 filed Jun. 29, 2001 now U.S. Pat. No. 6,586,942 and Ser. No. 10/118,706 filed Apr. 8, 2002 now U.S. Pat. No. 8,641,474.

FIELD OF THE INVENTION

The present invention relates to a control apparatus that interfaced with a hand held miniature electronics article, particularly applicable as a racing vehicle set.

BACKGROUND OF THE INVENTION

Traditional portable electronics/electrical devices such as electrical tools or toys draw power from the batteries installed inside the devices. The number of batteries required depends on the working voltage specified by the circuit utilized. For many electronics circuits, three batteries are needed to provide a typical working voltage between 3V to 4.5V. The working voltage required by many microcontroller chips are in between 3V to 6V. In order to provide a reasonable working battery life to a device drawing a current over 100 mA, such as the products that comprise a light bulb, motor or speaker, the size of the batteries selected are typically of AA, C or D size batteries. These batteries not only add considerable weight to the device, it limits the ability of the designer to shrink the product size. It is the objective of this invention to provide a system that does not required bulky batteries to be built inside a hand held article of sales such as a toy size racing vehicle.

SUMMARY OF THE INVENTION

The present invention is firstly directed to a racing vehicle that comprises a electrical circuit inside the vehicle. A first characteristic of this system is that there is no battery required inside the vehicle for the internal electrical circuit to perform it's normal function. A second characteristic of the system is that the vehicle itself is used as part of the joystick controller for the user to control, steer or race the vehicle. A third characteristic of the system is that the information about the characteristics of a vehicle, or a race, is fed to an external control apparatus through conducted contacts, typically the finger contact of the vehicle. A fourth characteristic of the system is that each vehicle can be reconfigured or upgraded electronically, and the upgraded vehicle can be traded with other players.

In a first embodiment, an interactive electronic racing play set comprising a stretch fabric glove attached with two finger contacts and a power module which houses an LCD display, control buttons, batteries and a speaker. The play set further comprising a base/joystick and a series of racing vehicles. The object of this game is to race the clock or with multiple opponents on a selected racetrack for points. Earned points can be converted into upgrades that can be applied to vehicles such as cars, trucks or motorcycles.

Typical car size is 36th scale or at a size that is comfortable to be held against the palm of a player. The glove that equipped with contact points at the index finger and thumb must be worn to interact with the car. When picking up a vehicle with the glove, the power inside the controller box of the glove is fed to the vehicle through the finger contacts. An identification circuit built inside the vehicle such as an integrated circuit (IC) or an identity resistor will identify the vehicle to the controller box of the glove. Engine noises and racing sounds personalized to the particular selected vehicle can then be generated.

Next, the controller attached on the glove may ask if the player wants to race or look at the inventory. If race, the options are for multiple or single player modes. If the multiple players mode is selected, it will ask the players to shake hands with opponents to register and synchronize the racing clock on each controller. Each player must select the same track. The player must place the car onto the base, which houses a joystick for forward and reverse control. Twisting the car will determine the steering direction. The racetrack is displayed on the LCD screen, located on top of the controller box. The control signals input through the car are conducted to the controller box through the finger contacts. These signals move an icon along the racetrack. The control mechanism can be built inside each vehicle or inside the joystick base. The winner is who finishes the race first with the least mistakes, or with the best score. The game is not limited to regular racetracks. Typical adventure games to score point can be included in the competition. The games control software is preferred to be interfaced with the controller circuit inside the controller box. Additional racetracks or games can be provided through additional external cartridges. The challenger, who is also the timekeeper, must shake hands again with all the opponents to determine the winner. The challenger also will pick up all the scores at the end of the race. The handshake, a sign of sportsmanship, is in fact a mode of transferring digital information from glove to glove. Each glove has two contacts, one on the index finger the other on the thumb. In addition, each glove has two additional conductive patches. By shaking hands, the contacts of one glove will touch the patches of another glove, thus enabling information exchange. The winner will be awarded points, which he can compile or exchange for upgrades or modifications. To encourage team play, the points awarded in multiple players mode is much higher than the solo mode, at which the player race against the clock.

Typical examples of vehicle enhancement are upgrading of tires, suspension, exhaust system, handling mechanism, steering angle, turbo engines, high torque transmissions, vehicle body weight and brakes. All these elements are examples of performance parameter of the racing vehicle embodiment. Performance parameters of a toy are defined as the parameters that enable two or more comparable toys to compare the performance of each other. Upgrading a first toy is defined by the play pattern to add performance parameter to said first toy, or to elevate the performance parameter of said first toy from a lower level to a higher level for said first toy to outperform a comparable second toy without such upgrade. Each vehicle in the product line may have a different personality. The controller or LCD game console attached on the glove provides a variety of racetracks; each also has a different personality and game rule. A first racetrack simulates off road conditions while another racetrack tests the acceleration capability of the vehicle. A suitably upgraded vehicle will perform better in a particular racetrack. Accordingly the game play requires the player to plan for good strategy, and build a vehicle that best fit the nature of the racetrack. To enhance fun of the games, a complete game is recommended to include a number of racetracks, and each vehicle is allowed to appear only in one racetrack. Accordingly a proper strategy and planning is required to put appropriate vehicle on the different racetracks according to their characteristics.

To further enhance the play value, although the features of each vehicle are upgradeable, not all vehicles are capable to be upgraded to provide the maximum performance for every upgradeable feature. For example, the best turbo engine of car A may deliver a maximum power of 500 horse power while that of car B is just 420 horse power. However, the steering angle upgradeable for car A is 25 degree while that of car B is 32 degrees. In these examples, each of the performance parameters "power" and "steering angle" is represented by a value that may be upgraded. It means car B is more responsive to sharp curves driving than car A as determined by the different values of the "steering angle" of car A and car B. The upgraded features are preferred to be memorized in a memory located inside the vehicle. As understood by a person having ordinary knowledge in the art, memory or memory means herein refers to any art recognized device or component capable of storing data. The car can than be traded with any players in exchange of points, or money represented by the points. Alternately, the upgrade record of a vehicle can be maintained at the memory located inside the controller box attached to the glove. In this case, the trading of the vehicle requires a title change hand shake that transfers the ownership of a car from a first glove to a second glove in exchange for the points from the second glove.

In an alternate embodiment, the controller box equipped with the LCD display is placed at the side of the controller. A connector interfaced the controller box with the electrical circuit built inside the vehicle and also the driving control signals. In this situation, data exchange between controller boxes can be achieved by wired or wireless communication channels. Alternately, the controller box can be removed and reattached to the glove for the handshake mode of data exchange.

The personalized sounds generated by each vehicle during the game play can be embedded inside the electrical circuit of each vehicle or stored inside the controller box. A timer counter or clock keeping track of the playing time record for each vehicle is preferred. If a vehicle is not run or raced for a certain time, the upgradeable features of the vehicle may be degraded, a sign of lack of practice and maintenance. The player is required to pay for maintenance to bring the vehicle back to it's original condition. This provision encourages the player to regularly playing with all the vehicle collections in order to keep all the vehicles at it's premium conditions ready for racing.

Although a play set of racing vehicles are used to demonstrated the invented technology, other embodiments of the article including dolls, action figures, toy characters, airplane, helicopter, toy size electrical hand tool or other different toy articles can be used with a properly designed different game rule. A motor can also be included in many of these toy articles to provide different responses. For example, a motor can be installed together with the joystick mechanism or with the glove to provide vibration feeling or other kinds of animation.

It should also be noted that the glove attaching with the controller box and the conductive fingertips could be structured in other different forms without sacrificing the merit of the invention. As compared with traditional hand held LCD games, the play set enables the involvement of physical miniature size objects, such as toy size motor vehicles. Identity and personalized characteristics can be stored inside the physical objects. In addition, the toy size vehicles is becoming an important part of the driving and steering mechanism during the race. Actually "driving" the vehicle gives the player more real feeling than regular joystick controllers. The introduction of finger contacts for a controller box to communicate with the physical object, the joystick base or a second controller box brings the fun of the play set to a new level. The finger contact design can be achieved in different ways including but not limiting to attaching conductive finger contacts to a glove.

The novel features of the invention are set forth with particularity in the claims to be followed. The invention will best be understood from the following description, when read in conjunction with the accompanying drawings.

DETAILED DESCRIPTION

Figure 1:
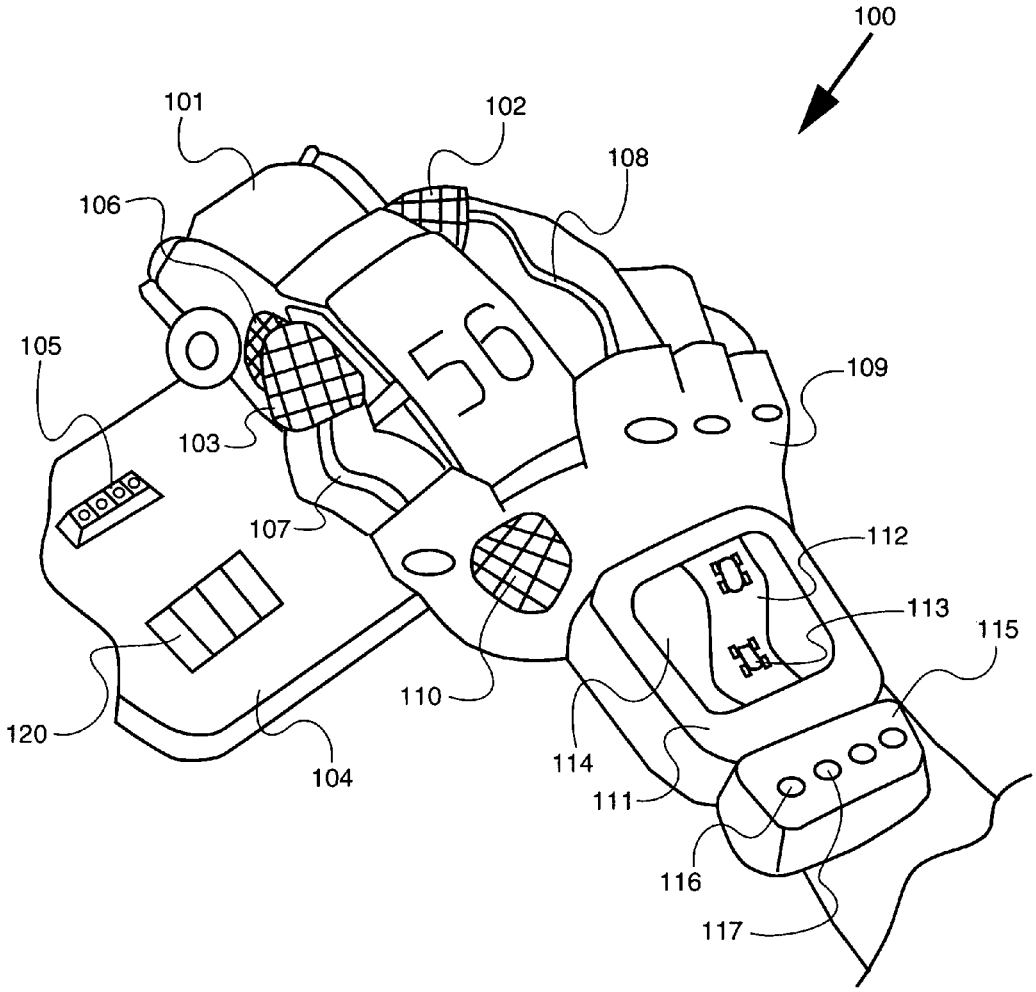
FIG. 1 is an embodiment having a controller attached to a glove; the target toy vehicle is contacted by the finger contacts connected to said controller.

Attention is initially directed to FIG. 1, which depicts a play, set comprising a controller embodiment or game unit embodiment and a vehicle embodiment. The controller embodiment is represented by the controller box or name unit 111 having a LCD panel 114, the glove 109 and the finger contacts 102 and 103. The vehicle embodiment is represented by the racing vehicle 101 connected to a joystick supporting base 104. The controller box or game unit 111 is attached to a glove 109 by velcro or other attachment members. A LCD panel 114 is provided on top of the controller box or name unit 111 for displaying a game play such as a racing tack. Buttons 116 and 117 enables the player to select options, different play modes or to provide responses according to the request of the game play.

More than one vehicles, each has a different personality are provided for the product line. In an example game play, the hand wearing the glove 109 picks up the vehicle 101. The controller box 111 is interfaced with the internal electrical circuitry of the vehicle 101 through the finger contacts 102, 103 and the conductive pads 106 located on the two sides of the vehicle. An identity circuit inside the vehicle enables the controller box 111 to identify which vehicle was picked up. The vehicle is then connected to a joystick mechanism located on the joystick base 104. The relative movements of the vehicle 101 against the joystick base 104 is converted in to vehicle movement control signals such as acceleration, braking and steering. These control signals are fed to the controller box 111 through the finger contacts 102, 103 and 106 between the glove and the vehicle. The received control signals directs the movement of the icon 113 that represents the vehicle 101 racing on the race track 112. The connector 105 and velcro 120 are provided as an option for the controller box 111 to be connected to the base 104 instead of being attached to the glove 109.

It should also be noted that each glove 109 is preferred to have a pair of conductive pads, one on each side of the hand. Conductive pad 110 locates at the backside of a hand. These conductive pads are provided for exchange of information in between the controller boxes between players. It should be noted that only two conductor lines are provided for the data communication and power supply purposes. There are different data information to be communicated in between these two lines in both directions. Accordingly, the data flowing through this communication channel are arranged in the form of data packets transmitted in serial format. Handshake signals or directional control signals are also required in between data packets to properly handle the direction of information flow.

Figure 2:
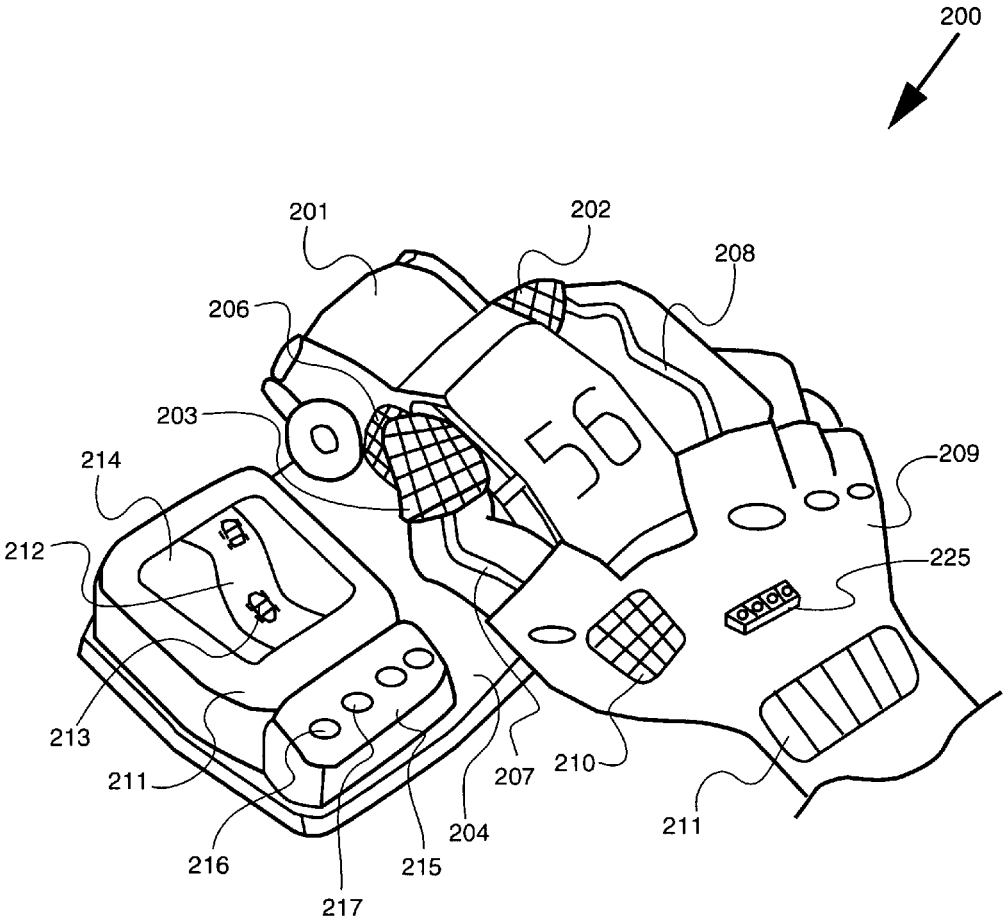
FIG. 2 illustrates another preferred embodiment of said vehicle play set making use the vehicle as part of the joystick mechanism for driving control.

Attention is now directed to FIG. 2 illustrating the alternate embodiment for the controller box 211 to be located on the joystick base 204 instead of the glove 209. The power supply and also the control signals in between the controller box and the racing vehicle 201 are interfaced through the socket 105 as shown in FIG. 1 and another mating socket located beneath the controller box 215. Normally the power supply is preferred to be positioned inside the controller box.

Although the controller box 211 is shown as a configurable design allowing the unit to be attached either to the joystick base 204 or the glove 209, it is the desire of another preferred embodiment to integrate the controller box 214 with the base unit 204. In this case the handshake data exchange operation is preferable to be replaced by a wired or wireless communication links in between two controller boxes. Typical wireless communication link are represented by infra red, ultrasonic or RF communication links.

Figure 3:
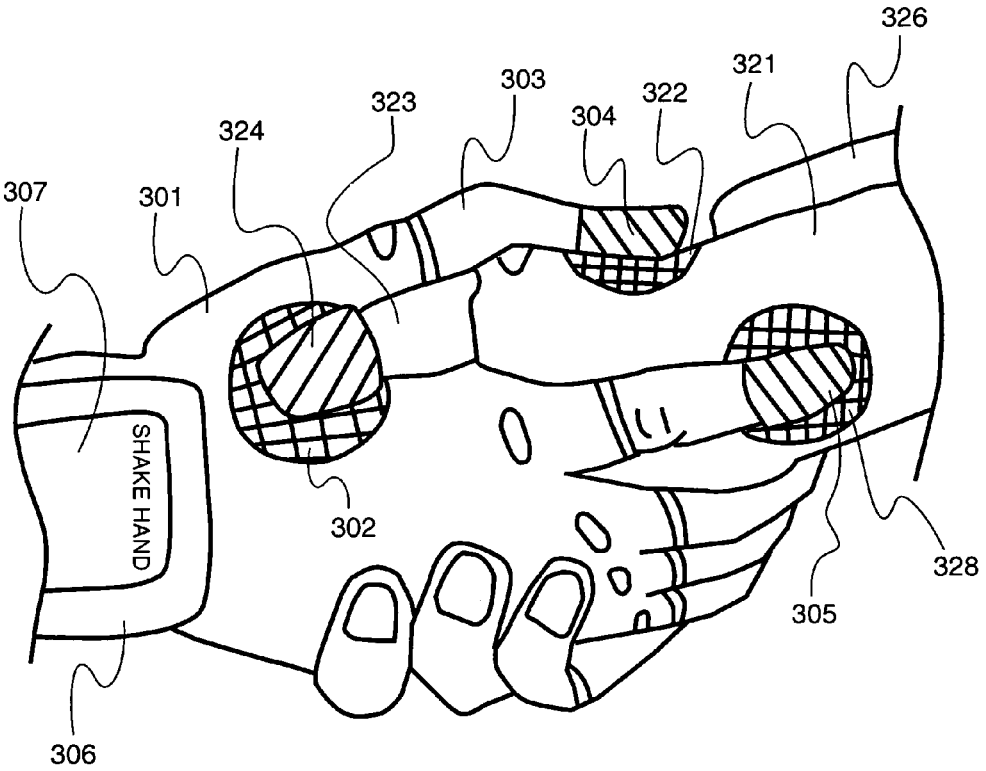
FIG. 3 illustrates how the finger contacts interface two controller boxes through a hand shake.

Attention is now directed to FIG. 3, which illustrates how a sportsmanship hand shake enables the data transfer and synchronization between two controller boxes. When the LCD displays of two different controller box are programmed to exchange data, the players are prompted to start exchanging the information be shaking hands. As illustrated by FIG. 3, the thumb contact 304 of player A is in contact with the conductive pad 322 of user B. The forefinger 305 of player A is in contact with the conductive pad 328 located at the palm side of user B. Similarly the thumb and forefinger of user B are also in contact with two conductive pads connected to the controller box of user A. Accordingly four conducting paths are provided in between the two controller boxes allowing data to flow in two directions. Before a car race is initiated, player A and B shake hands. This action synchronizes and starts the racing start count down clock inside the two controllers. Players A and B may shake hands with player C and D to download their count down clock value into the racing count down clocks of players C and D. Accordingly the count down clocks of all the players are synchronized that will command the LCD panels and controller boxes of all the players to start the racing game at the same moment. After the racing is over, the leading player shakes hand with each of the other players and their scores are compared and the winner will be announced. During another hand shake with the final winner, the winner controller box is allowed to deposit a generous sum of money represented by winners reword points. The winner is then able to make use of these reward points to upgrade any vehicle he possessed. Suppose a player run short of points, or money that is represented by points in the game, the player is able to trade one of his car with another player for a particular amount of points. After a handshake, the title of the car and the agreed amount of points will be exchanged.

Figure 4A:
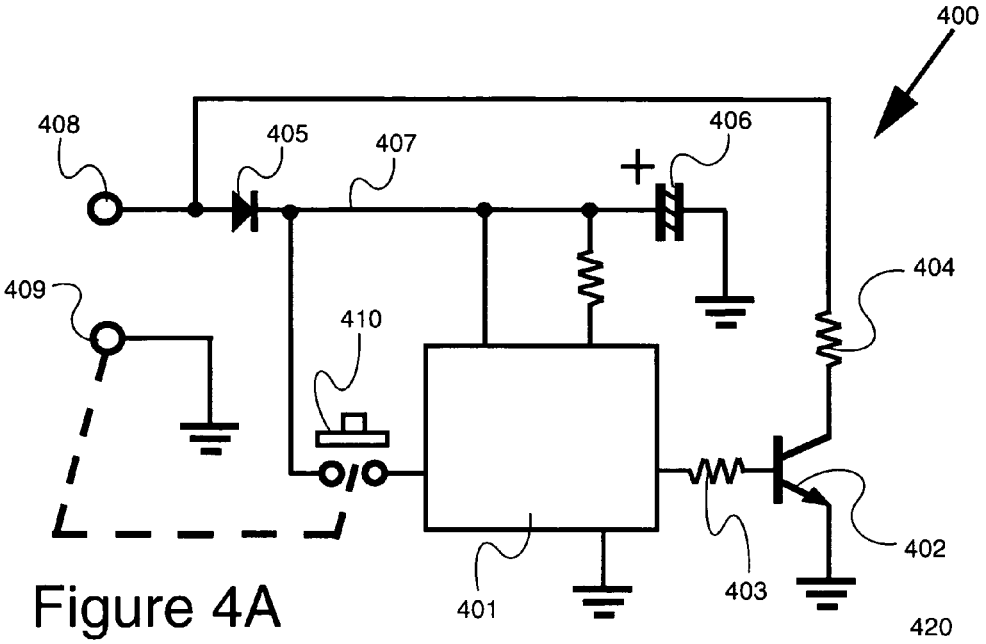
FIG. 4A is an embodiment of an interface circuit built inside an article of sales.
Figure 4B:
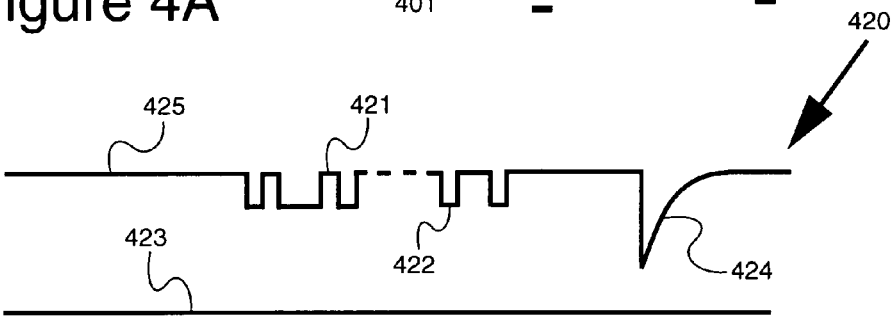
FIG. 4B is the waveform of the electrical current flowing through the contact terminals and the interface circuit of FIG. 4A.

Attention is now drawn to FIG. 4A illustrating a preferred embodiment of an electrical circuit 400 included inside the body of a vehicle. This circuit is able to generate digital signals when power is received. The digital signal can be used for signaling the identity of the vehicle or to serve other applications. The contact terminals 408, 409 represents the conductive terminals positioned at the two sides of the vehicle, such as the contact terminal 106 of the toy car 101 in FIG. 1. The heart of the circuitry is a microcontroller 401. The microcontroller is powered by the external voltage obtained from terminals 408 and 409. The capacitor 406 is included as a filter and also a power reservoir to store electrical energy when the contact terminals are momentarily out of contact. When power is connected to the contact terminals 408, 409, the microcontroller is powered up. At this moment, the voltage waveform across the terminals 408 and 409 is illustrated in FIG. 4B. Once the electrical circuit is stabilized, the microcontroller 401 generates a series of pulses 421 and 422 according to the nature of the target article. These pulses turn the transistor 402 ON and OFF. Accordingly it gives a pulsing loading to the power line through the resistor 404. The amplitude of the pulses 421 and 422 are determined by the value of the resistor 404 and the internal impedance of the interfacing facing circuit at the controller end. The pulses 421 and 422 are then processed by the electrical circuit at the controller end. Responses are generated according to the pulses detected. The diode 405 of FIG. 4A is included to attenuate the pulsing signal to enter the power supply line 407 of the microcontroller circuit.

In order to determine when the microcontroller 401 should generate pulses and what kind of pulses can be generated, a trigger switch 410 is included in the circuit 400. The switch 410 is preferably be integrally positioned right behind the contact terminal 409, so that the switch 410 can be triggered by the same finger accessing the contact terminal 409. Another advantage of this design is that the electrical circuit can be set to a low power standby mode to conserve energy. The circuit is revoked to the normal operation mode only when this controller switch is triggered.

Figure 4C:
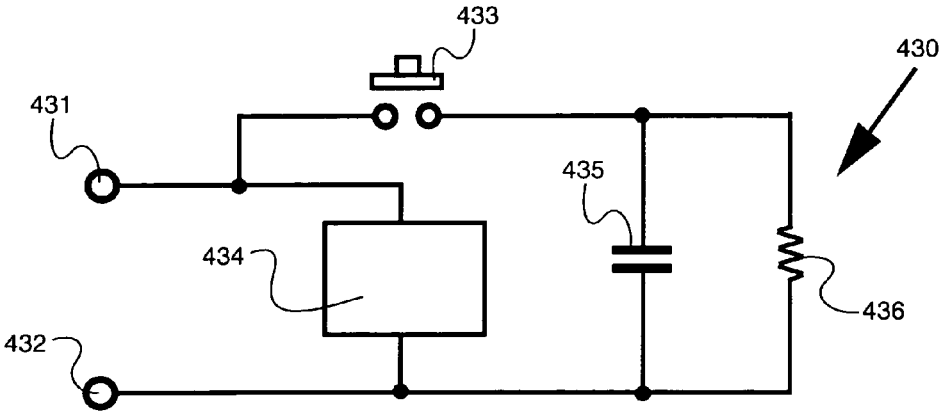
FIG. 4C is another interface circuit built inside an article of sales.

FIG. 4C illustrates another generic circuit applicable for the vehicle. The block 434 represents the working circuit of the vehicle. Triggering is provided by pushing the switch 433, which connects the capacitor 435 to the power line of the circuit. The capacitor 433 will provide a momentary negatively going triggering pulse 424 as shown in FIG. 4B. This trigger pulse will be useful to trigger the electrical circuit located at the controller end and to reset the electrical circuit 434. The resistor 436 is included for discharging the capacitor 435 when the trigger switch 433 is released.

Figure 5A:
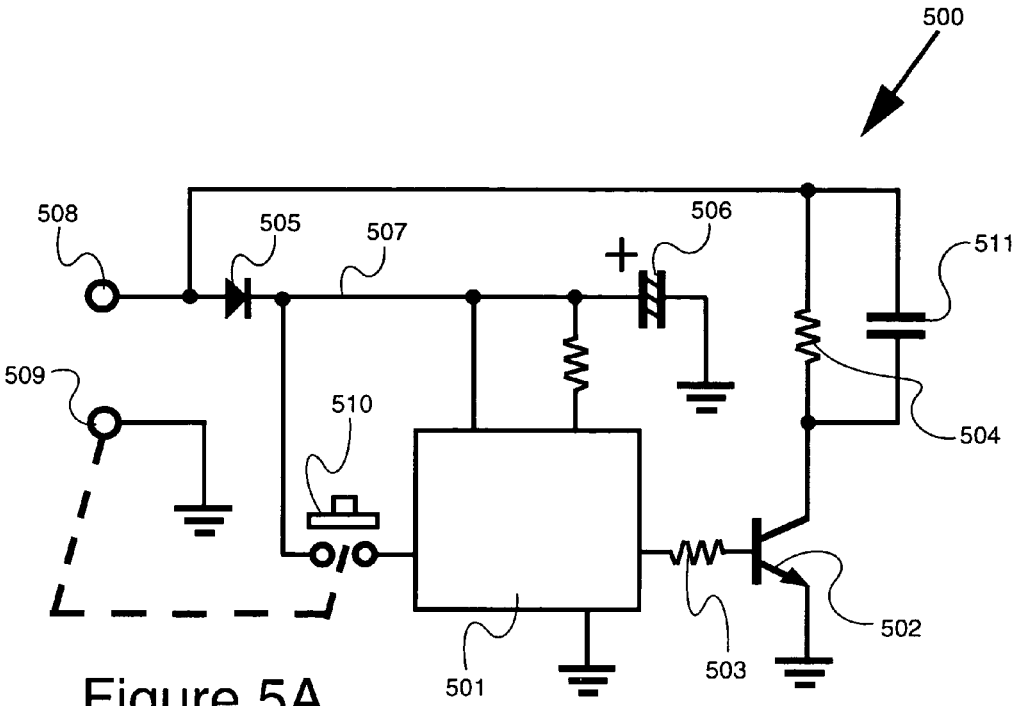
FIG. 5A is an example of a sound generating interface circuit built inside an article of sales.
Figure 5B:
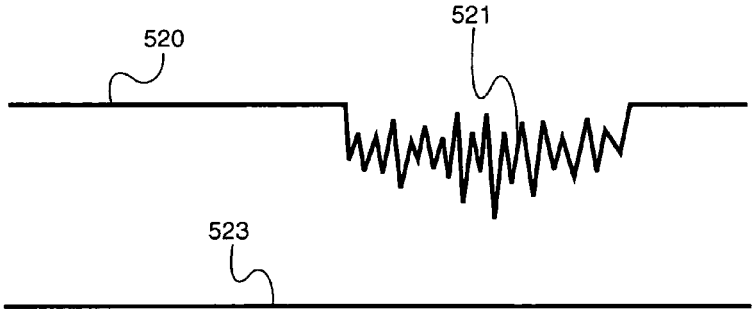
FIG. 5B is the waveform of the electrical current flowing through the contact terminals and the interface circuit of FIG. 5A.

FIG. 5A is a design alternative of FIG. 4A, wherein the functional block 501 generates an analog signal such as a voice waveform. This voice waveform is amplified by the transistor 502 and coupled to the contact terminal 508 by the capacitor 511. The DC voltage measured across the terminals 508 and 509 are represented by the voltage waveform 520 of FIG. 5B. The coupled AC signal is represented by the analog waveform 521 which is picked up by the controller box through the finger contacts. These analog signals are extracted and amplified to drive a speaker located at the controller end. Since the circuit 500 is not required to drive a speaker, a substantial high impedance resistor can be added in series with the contact 508 to define the internal impedance of the communication line and also to reduce the current flowing through the circuit 500.

Figure 6A:
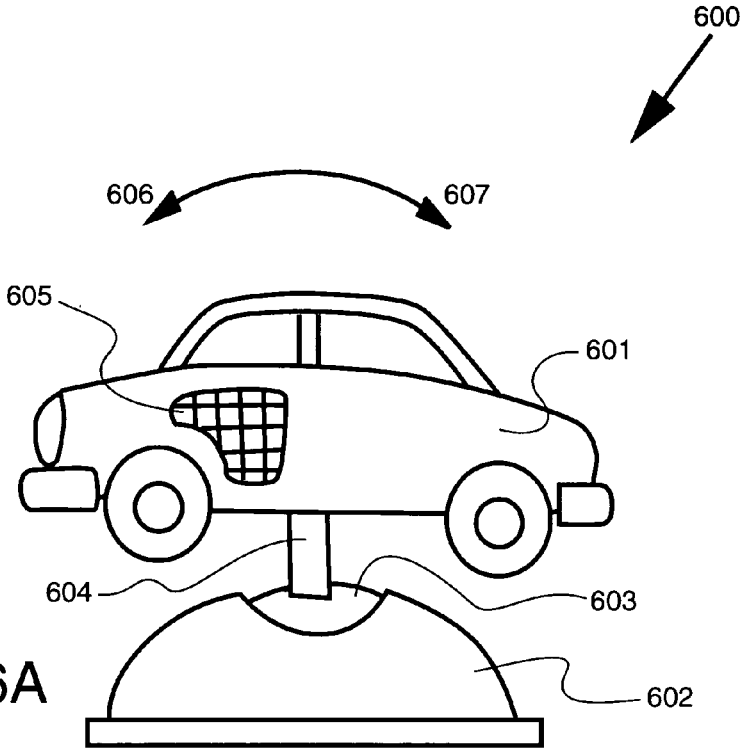
FIG. 6A illustrates a preferred embodiment of the joystick controller.

FIG. 6A illustrates the motor vehicle 601, which is inserted to the top of the joystick 604. When the position of the vehicle 601 is moved relative to the base 602, driving signals in serial packet of pulses are sent to the controller box through the finger contacts 605 located at the two sides of the vehicle 601. When the vehicle 601 is moved towards the direction 606, a move forward signal, or acceleration signal is generated. When the car 601 is moved backward in the direction 607, a braking signal is generated to slow down the racing car on the LCD screen. It is preferable to provide a digital signal indicating the magnitude of movement of the vehicle in the directions 606 and 607 so that the speed of the vehicle can be properly controlled.

Figure 6B:
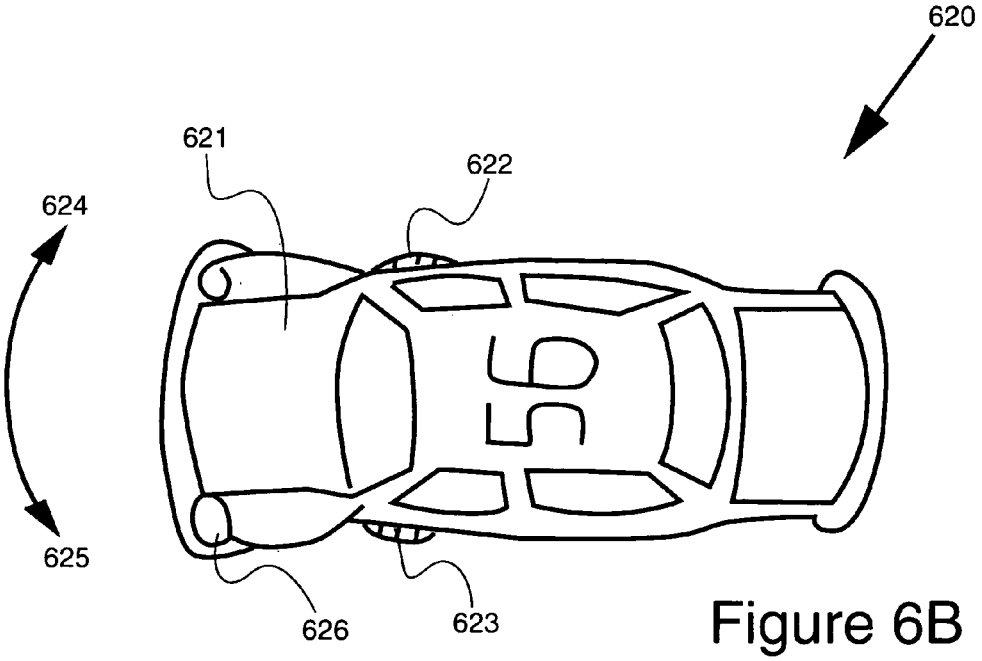
FIG. 6B illustrates the top view of the joystick controller of FIG. 6A.

FIG. 6B illustrates the top view of the vehicle 601. When the vehicle is turned towards right in the direction 624, a right turn signal is sent. Similarly a left turn signal is sent when the vehicle is steered towards the direction 625. Digital proportional steering is also preferable to provide smoother steering control to the racing vehicle.

Figure 7A:
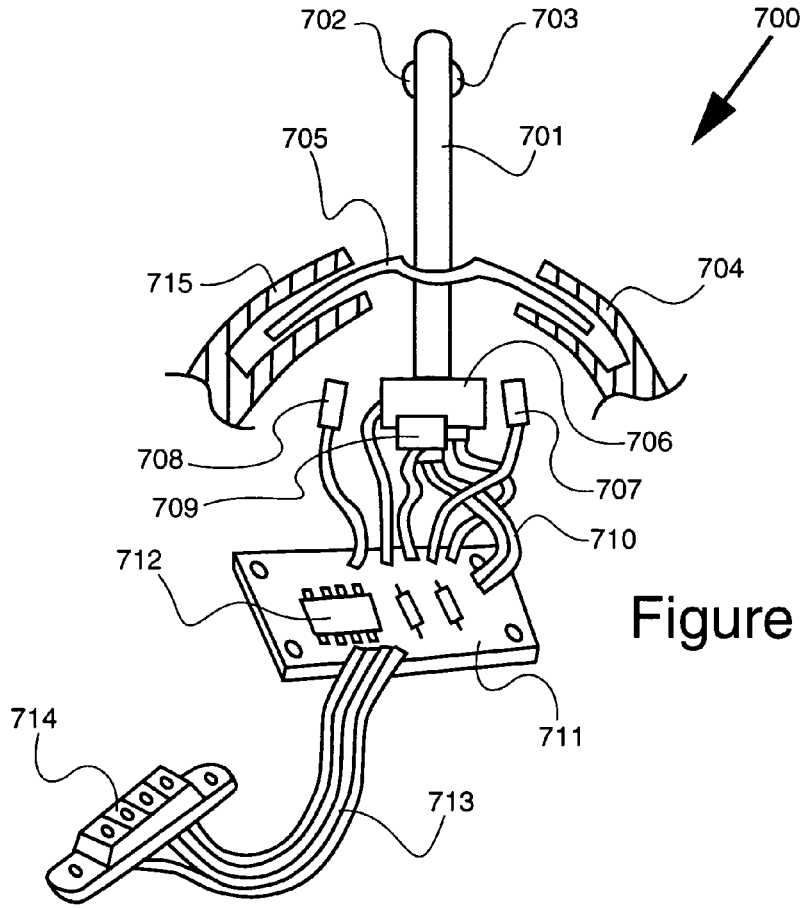
FIG. 7A illustrates the internal structure of a joystick embodiment for use with the preferred embodiment of FIG. 2.
Figure 7B:
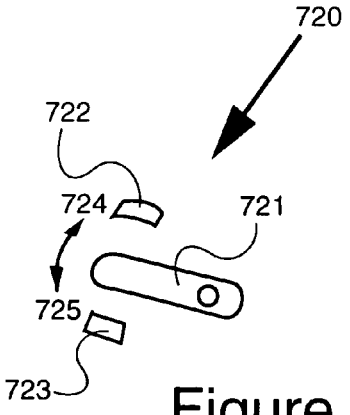
FIG. 7B illustrates the an electrical circuit to indicate driving direction.
Figure 7C:
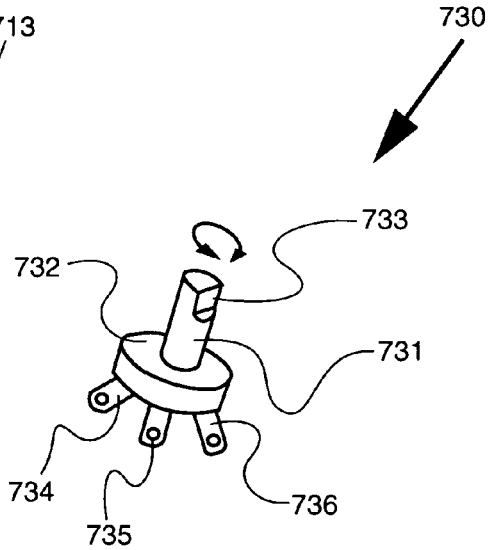
FIG. 7C illustrates a rotating resistor potentiometer; an alternate electrical circuit to provide analog or digital proportional driving information.

FIG. 7A illustrates an embodiment of the joystick controller. The guiding plate 705 and housing 704 represent the plate 603 and the housing 602 of FIG. 6A respectively. The joystick 701 is inserted into the bottom plate of the racing vehicle 601 of FIG. 6A. The contact points 702 and 703 is connected to the electrical circuit located inside the vehicle so as to receive the identity signal or to exchange information with the racing vehicle. The contact plates 706, 707, 708 and 709 represents the simple version of switch to indicate the directional movement of the vehicle. When the central contact plate 706 is in contact with the contact plate 707, the car is in forward moving direction. Contact plate 708 is positioned to determine the braking position of the controller. A microprocessor 712 picks up all these directional signals and send it to the controller box through the connector 714 as illustrated in FIG. 2. FIG. 7B illustrates the contact design to define steering directions. When the contact plate 721 is in contact with the contact plate 722, a right steering signal is sent. When the contact plate 721 is in contact with the plate 723, a left steering signal is then transmitted. FIG. 7C is another preferred embodiment of the steering mechanism replacing the contact plates of FIG. 7B to provide digital proportional signals that measures the steering angle. The analog resistance value of the potentiometer 732 is converted into digital steering signals to be sent to the controller box. It should be noted that digital proportional signal is also preferred to simple contact switches for accelerating or braking the racing vehicle.

Figure 8A:
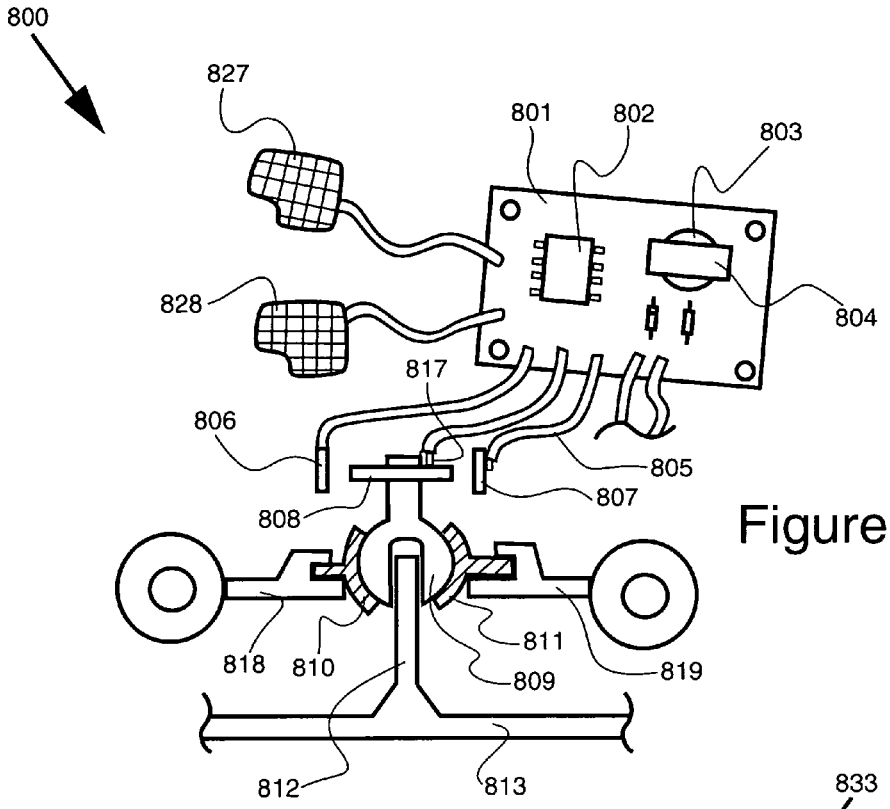
FIG. 8A illustrates the internal structure of a joystick embodiment for use with the embodiment of FIG. 1.

FIG. 8A illustrates another preferred embodiment that moved the control mechanism and electronics from the joystick supporting base into the motor vehicle. Accordingly the joystick supporting base 813 is a simple supporting base that provides the solid joystick 812, which is inserted into a ball joint 811 located beneath the vehicle 818. The control movement of the vehicle enables the contact 827 to touch the contact plates 807 and 806 to signify acceleration or braking motions. All these control signals, together with the steering signals are fed to the controller box through the contact pads 827 and 828 by the microprocessor 802, as shown in the embodiment of FIG. 1. It should be noted that the ownership and/or upgrade information of a vehicle can be stored inside a vehicle. In order to retain these information data after the power supply derived from the controller box is removed from the controller pads 827 and 828, a nonvolatile memory is provided for the electrical circuitry 804. Alternately a local back up power supply represented by the battery 803 is provided to maintain the information stored in the low standby current memory of the circuit board 804.

Figure 8B:
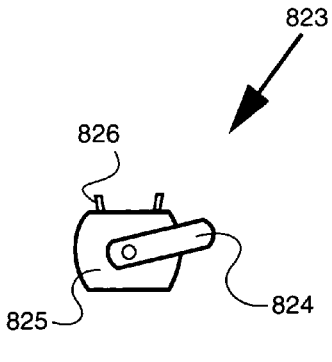
FIG. 8B illustrates a motor providing vibrating effect to the controller box or the joystick embodiment.
Figure 8C:
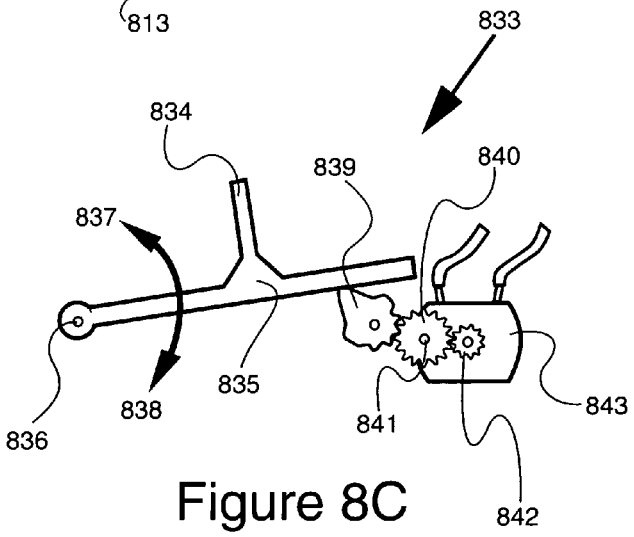
FIG. 8C illustrates an alternate motor mechanism providing vibration to a joystick assembly.

FIG. 8B illustrates a motor 825 installed inside the racing vehicle. This motor is connected to an uneven load 824 which when rotates, provide a vibrating feeling to the racing vehicle, that increases the fun and feeling of racing. FIG. 8C illustrates an alternate embodiment to provide a different kinds of vibrations such as in the case of a off road racing. The motor 843 is geared down to drive an irregular shaped cam 839, which in turn moves the joystick base 835 up and down.

Although FIG. 1 illustrates the vehicle to be controlled by the right hand of the player having a glove attached with the controller box, alternate embodiment is possible to provide a left handed glove to hold the joystick base 104. This will enable the controller box attached to the left handed glove to maintain finger contact with the base 104 so as to communicate with the electrical circuit as shown in FIG. 7A. In this arrangement, the racing vehicle is controlled by the right hand without wearing the glove.

From the foregoing, it should now be appreciated that the applicant has disclosed herein embodiments of a controller device configured to power or interface an electrical powered article of sales. It is intended that the article of sales does not require internal battery as a power source. The electrical power needed by the target article are derived from the controller compartment by finger contacts. Particularly, it should be noted that there are different variations of finger contact designs, different ways to attach a contact terminal to the finger of a human hand and different methods to mount the controller box to the body of the user. Although detailed embodiments of the invention have been disclosed, it is recognized that variations and modifications, all within the spirit of the invention, will occur to those skilled in the art. It is accordingly intended that all such variations and modifications be encompassed by the claims to be followed in the formal patent application of the invention.

As understood by a person having ordinary knowledge in the art, it should be note that the term "hand" described in this specification is defined by the terminal section of a human upper limb beyond the wrist section and does not include the wrist section. Typically the "hand" section includes the section of the palm and the fingers. Similarly the term "handshake" is defined by shaking the "hands" of two persons, and a "hand attaching members" is defined as a member attached to a hand, as commonly understood by a person having ordinary knowledge in the art.

What is claimed is:

1. A method to provide a first game play set to a first player comprising the steps of:

(1) providing a control member;

(2) providing a family of n accessory toy members;

(3) defining m performance parameters for said family of n accessory toy members; at least one performance parameter is represented by x upgradeable values (4) defining a default personality to each of said n accessory toy members; said default personality is represented by the performance parameters assigned to said accessory toy member;

(5) providing an identification circuit to each of said n accessory toy members for said control member to identify an accessory toy member interfaced;

(6) selecting one of said n accessory toy members to interface with said control member for participating in a game play;

(7) defining a method to upgrade the value of at least one performance parameter of said selected accessory toy member; and (8) providing first data memory to memorize the upgraded performance parameter value of step (7);

(9) before the game play, establishing communication with a second game play set to initialize the game play for said first game play set;

(10) starting the game play for said first game play set;

(11) after the game play, establishing communication with said second game play set to exchange data between said first game play set and said second game play set; wherein said method further comprising a step to provide the second game play set to a second player; said game play set also comprising the equivalent steps (1) to (11) for said second player; and said second game play set is connected with said first game play set during steps (9) and (11) and separated from said first game play set during step (10).

2. The game play method of claim 1 further comprising a step of:

(12) announcing a winner according to scores achieved by said first and second players from their game plays.

3. The game play method of claim 1 wherein the data of said first and second game play sets are communicated through a hand shake motion between said first and second players.

4. The game play method of claim 1 further providing a step to downgrade the performance parameters of said selected toy member when said selected toy member had not been serviced or involved in a game play for a predefined period of time.

5. The game play method of claim 1 further providing a step enabling said first player to trade the performance parameters of a selected toy member with a second player.

6. A game or toy play set comprising:

a control member;

a family of n accessory toy members;

first data memory provided for defining m performance parameters for said family of accessory toy members; wherein at least one performance parameter is represented by x upgradeable values;

identification circuit attached to each of said accessory toy members enabling said control member to identify an accessory toy member selected;

interfacing circuit configured for an accessory toy member to interface with said control member;

program storage memory for storing a program defining the criteria to upgrade or downgrade the performance parameter of an accessory toy member; and first and second conductive members structured for the player of said game or toy play set to communicate data with another game or toy play set through a hand shake motion.

7. The game or toy play set of claim 6 wherein said program storage memory stores a program requiring timely services or game play to maintain or enhance the performance of said accessory toy member.

8. The game or toy play set of claim 6 comprising nonvolatile memories attached to each of said accessory toy members.

9. The game or toy play set of claim 6 wherein said program storage memory stores a program enabling a player to trade an accessory toy member with another player.

10. The game or toy play set of claim 6 further comprising a display device.

11. A method to provide at least a first game play set to a first player; and a second game play set to a second player; said method comprising the steps of:

(1) providing a first data generating circuit to said first game play set and a second data generating circuit to said second game play set;

(2) providing a first communication unit to said first game play set and a second communication unit to said second game play set;

(3) providing a first hand attaching member structured for attaching to the hand of said first player and for connecting with said first game play set;

and providing a second hand attaching member structured for attaching to the hand of said second player and for connecting with said second game play set; wherein said first hand attaching member and said second hand attaching member are positioned and configured for providing conductive communication between said first communication unit and said second communication unit through a hand shake motion between the hand of said first player and the hand of said second player and for said first player to communicate data with said second player.

12. The method of claim 11 further comprising the steps of:

(4) providing a control member for each game play set;

(5) providing multiple accessory toy members for each player;

(6) defining two or more performance parameters for each of said accessory toy members;

(7) defining a default personality to each of said accessory toy members; said default personality is represented by the performance parameters assigned to said accessory toy member;

(8) providing an identification circuit to each of said accessory toy members;

(9) for each of said control members, selecting one of said accessory toy members to interface with said control member for participating in a game play;

(10) defining a method to upgrade the performance parameters of said selected accessory toy member; and

(11) providing a first data memory to memorize the upgraded performance parameters of said selected accessory toy member;

(12) providing each of said first and second players a score after the game play of step (8);

(13) arranging the communication units of step (2) to communicate the score and/or performance parameters information between said first and second players; and

(14) announcing a winner according to the scores achieved by said players.

13. A game or toy play set comprising:

first electronics circuit structured to provide data for said game or toy play set to communicate with an external game or toy play set;

a first hand attaching member structured for attaching to the hand of a player and for connecting to said first electronics circuit;

communication unit structured for said game or toy play set to communicate with said external game or toy play set through a hand touching connection when said first hand attaching member touches said external game or toy play set;

a control member;

a family of n accessory toy members;

first data memory defining m performance parameters for said family of accessory toy members; wherein at least one performance parameter is represented by x upgradeable values;

identification circuit attached to each of said accessory toy members enabling said control member to identify an accessory toy member selected;

interfacing circuit configured for an accessory toy member to interface with said control member;

program storage memory provided for storing a program defining the criteria to upgrade or downgrade the performance parameter of an accessory toy member; and first and second conductive members structured for the player of said game or toy play set to touch and to communicate data with another game or toy play set.

14. The game or toy play set of claim 13 wherein said program storage memory stores a program requiring timely services or game play to maintain or enhance the performance of said accessory toy member.

15. The game or toy play set of claim 13 further comprising nonvolatile memories attached to each of said accessory toy members.

16. The game or toy play set of claim 13 wherein said program storage memory stores a program enabling a player to trade an accessory toy member with another player.

17. The game or toy play set of claim 6 wherein said play set is structured for enabling said hand shake motion to be conducted between two human hands.

18. The game or toy play set of claim 6 wherein said play set is structured for enabling said hand shake motion to be conducted between a human hand and a joystick in contact with said human hand.

19. The game or toy play set of claim 13 wherein said play set is structured for enabling said hand touching connection to be provided in the form of a hand shake.

20. A game or toy play set comprising:

a first game unit;

a joystick separated from said first game unit and structured to be operated by a human hand of a player;

a first electronics circuit structured for said first game unit to communicate with said joystick;

a communication circuit configured or structured for said first game unit separated from said joystick to communicate with said joystick through a hand touching connection between said human hand and said joystick, when said human hand is operating said joystick;

wherein said hand touching connection is provided by a first data or signal communication member structured to attach to said human hand touching a second data or signal communication member located on said joystick when said human hand is touches said joystick.

21. The game or toy play set of claim 20 wherein said first game unit is attached to or carried by said player.

22. The game or toy play set of claim 20 further comprising an accessory toy member structured for attaching to said joystick and positioned in between said human hand and said joystick.

23. The game or toy play set of claim 22 wherein said human hand operates said joystick by moving said accessory toy member.

24. The game or toy play set of claim 22 wherein said accessory toy member is structured to provide conductive communication between said joystick and said first game unit.

25. The game or toy play set of claim 22 further comprising a motor mechanism to move said accessory toy member attached to said joystick during a game play.

26. The game or toy play set of claim 22 further comprising a second accessory toy member configured for separately connecting with said joystick and for said first game unit to communicate through said hand touching connection with said joystick.

27. The game or toy play set of claim 20 wherein said hand touching connection provides conductive communication between said first game unit and said joystick.

* * * * *